US005896990A

United States Patent [19]

Barzana

[11] Patent Number: 5,896,990

[45] Date of Patent: Apr. 27, 1999

[54] CONTAINER WITH CONSUMPTION INDICATOR

[76] Inventor: Ramon Barzana, 12246 SW. 100th St., Miami, Fla. 33186

[21] Appl. No.: 09/027,847

[22] Filed: Feb. 23, 1998

[51] Int. Cl.[6] ..... B65D 85/00; G09F 9/00

[52] U.S. Cl. ..... 206/459.1; 40/307; 116/309; 116/317; 215/230; 215/365

[58] Field of Search ..... 206/459.1; 215/230, 215/365; 40/306, 310, 307; 116/308, 309, 311, 315, 317, 227

[56] References Cited

U.S. PATENT DOCUMENTS

| | | | |
|---|---|---|---|
| 648,063 | 4/1900 | Bauman | 215/365 |
| 710,708 | 10/1902 | McShane . | |
| 2,111,637 | 3/1938 | Mehaffey . | |
| 2,644,452 | 7/1953 | Brown | 215/230 X |
| 2,767,680 | 10/1956 | Lermer . | |
| 3,040,982 | 6/1962 | Sanders . | |
| 3,151,599 | 10/1964 | Livingston . | |
| 3,285,459 | 11/1966 | Gahm . | |
| 3,424,336 | 1/1969 | Perez et al. | 206/459.1 |
| 3,471,957 | 10/1969 | Robb . | |
| 3,960,713 | 6/1976 | Carey . | |
| 3,996,879 | 12/1976 | Walton . | |
| 4,432,300 | 2/1984 | Lyss . | |
| 4,528,933 | 7/1985 | Allen . | |
| 4,827,643 | 5/1989 | Hearst et al. . | |
| 4,860,684 | 8/1989 | Al-Harbi . | |
| 4,877,119 | 10/1989 | Hosking . | |
| 4,901,457 | 2/1990 | Chandler . | |
| 4,913,083 | 4/1990 | Valvo et al. . | |
| 4,920,912 | 5/1990 | Kirkling . | |
| 4,951,596 | 8/1990 | Wallace, Jr. . | |
| 5,279,422 | 1/1994 | Adams . | |
| 5,356,012 | 10/1994 | Tang et al. . | |
| 5,386,795 | 2/1995 | Barttholomew . | |
| 5,482,163 | 1/1996 | Hoffman | 206/459.1 X |
| 5,520,278 | 5/1996 | Hughes | 40/310 X |
| 5,586,087 | 12/1996 | Silverson . | |
| 5,607,078 | 3/1997 | Nordberg et al. | 116/227 X |
| 5,706,948 | 1/1998 | Hughes | 40/310 X |
| 5,740,792 | 4/1998 | Ashley et al. | 116/317 X |

*Primary Examiner*—Bryon P. Gehman
*Assistant Examiner*—Ehlica Rionh
*Attorney, Agent, or Firm*—Farkas & Manelli PLLC; Edward J. Stemberger

[57] ABSTRACT

A container assembly is provided for use in monitoring consumption of a liquid from the container assembly. The container assembly includes a body constructed and arranged to hold a liquid. The body has a base portion and an opposing top portion. The top portion permits liquid to be supplied into and to be removed from the body. The base portion has a skirt member. Indicator structure is operatively associated with the skirt member for rotational motion relative to the body into a plurality of different positions. Indicia is disposed on the body to indicate consumptive uses of the container assembly. Complementary engaging structure is on the skirt member and on the indicator structure for mounting the indicator structure with respect to the skirt member in such a manner that rotation of the indicator structure is possible in one direction and rotation of the indicator structure is resisted in the opposite direction. The engaging structure including at least one protrusion on one of the indicator structure and the skirt member and a series of spaced recesses in the other of the indicator structure and the skirt member. Each of the recesses corresponds to a particular indicia, allowing the user, with each consumptive use, to rotate the indicator structure with respect to the body in the one direction to engage the at least one protrusion with a recess, thereby monitoring consumptive uses of the container assembly.

12 Claims, 3 Drawing Sheets

CONTAINER WITH CONSUMPTION INDICATOR

BACKGROUND OF THE INVENTION

This invention relates to a container assembly for holding liquids and for monitoring an amount of liquid consumed.

It has been widely accepted that drinking adequate amounts of water each day may be a health benefit for individuals. This is particularly true for overweight persons. Studies have shown that most overweight people don't drink enough water each day. A dietary program should include not only a monitored daily food consumption but also a program for monitoring daily water consumption. The standard contemporary formula for water consumption is that a dieting person, and indeed every person, should drink at least eight, eight-ounce glasses of water each day.

Dieters or others who practice this formula generally measure eight ounces of water in a measuring cup and pour the measured amount of water into a drinking glass, consume the water and then record the event on paper or the like. Others may simply estimate the volume of water in a conventional glass, drink the water from the glass and then record the event on paper, or rely on memory, to record how many glasses of water were consumed that day. These practices allow for possibilities of mistake and are also inconvenient and time-consuming.

Drinking vessels have been provided which also monitor the amount of water consumed each day. One such vessel is disclosed in U.S. Pat. No. 4,877,192 to Hosking. Hosking discloses a beaker having a groove in a top portion thereof. A collar is fitted within the groove for manual rotation relative to the beaker. The collar includes a window which aligns over numbers on the beaker to sequentially indicate a number of consumptive uses of the beaker through the window. A drawback of this device is that the collar may rotate with respect to the beaker in either direction. Thus, a user may inadvertently move the collar to an inaccurate consumption number or to a location between two adjacent consumption numbers.

SUMMARY OF THE INVENTION

An object of the present invention is to provide a container assembly which employs indicator structure to monitor the number of consumptive uses of the container assembly. The indicator structure may be moved sequentially in only one direction to a number indicative of a consumptive use and is thus prevented from moving inadvertently in the opposite direction to a position which indicates a previously recorded consumption number.

In accordance with the principles of the present invention, this objective is obtained by providing a container assembly for use in monitoring the consumption of a liquid from the container assembly. The container assembly includes a body constructed and arranged to hold a liquid. The body has a base portion and an opposing top portion. The top portion permits liquid to be supplied into and to be removed from the body. The base portion has a skirt member.

Indicator structure is mounted with respect to the skirt member for rotational motion relative to the body into a plurality of different positions.

Indicia is disposed on the body to indicate consumptive uses of the container assembly.

Complementary engaging structure is on the skirt member and on the indicator structure for mounting the indicator structure with respect to the skirt member in such a manner that rotation of the indicator structure is possible in one direction and rotation of the indicator structure is prevented in the opposite direction. The engaging structure includes at least one protrusion on one of the indicator structure and the skirt member and a series of spaced recesses in the other of the indicator structure and the skirt member. Each of the recesses corresponds to a particular indicia, allowing the user with each consumption use, to rotate the indicator structure with respect to the body in the one direction to engage the protrusion with a recess, thereby monitoring consumptive uses of the container assembly.

DETAILED DESCRIPTION OF THE PRESENTLY PREFERRED EXEMPLARY EMBODIMENT

Figure 2:
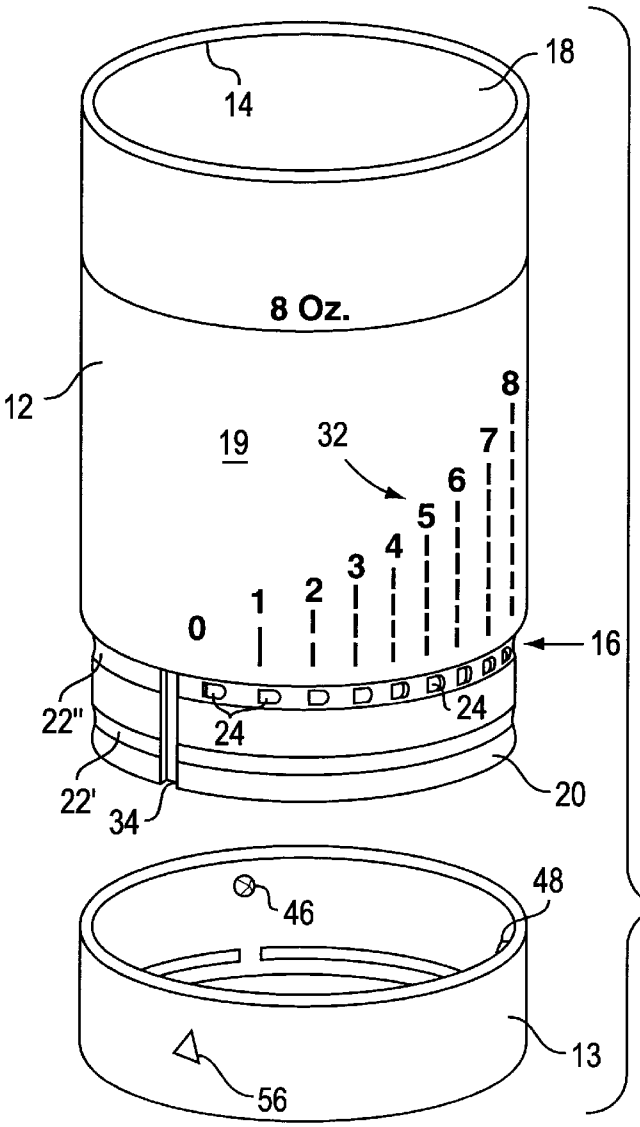
FIG. 2 is a perspective view of the container assembly of FIG. 1, shown with the indicator ring structure removed from a body of the container assembly.
Figure 1:
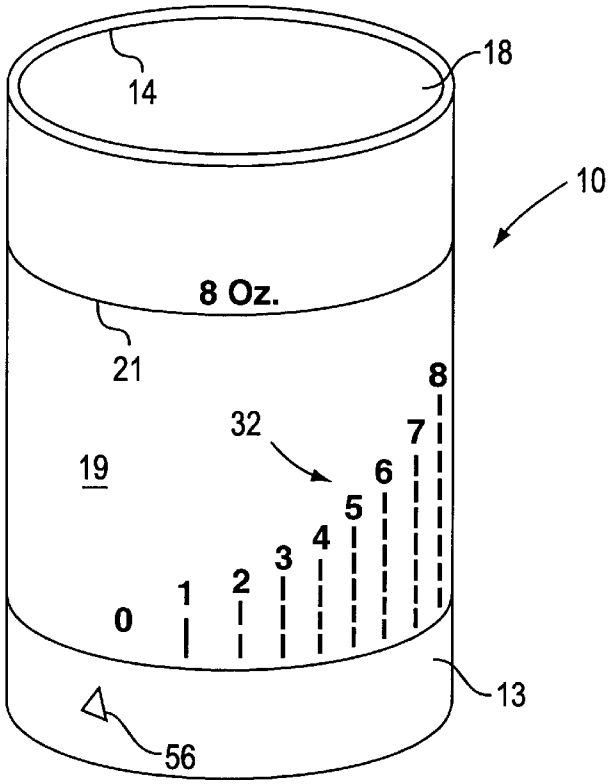
FIG. 1 is a front view of a container assembly provided in accordance with the principles of the present invention.

With reference to FIGS. 1 and 2, a container assembly, generally indicated at 10, includes a generally cylindrical body 12 and an indicator ring structure 13 coupled to lower portion of the body 12 for rotational movement with respect to the body 12. The body 12 and indicator ring structure 13 are each preferably molded from a plastic material.

Figure 3:
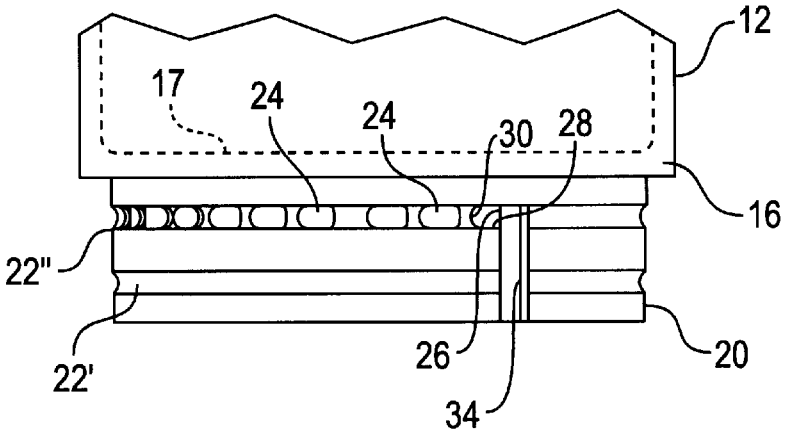
FIG. 3 is a front view of a skirt member of the body of the container assembly of the invention.

As best shown in FIGS. 2 and 3, the body 12 has a continuous sidewall 14, a base portion 16 including a bottom 17, and an open top portion 18 in opposing relation to the base portion 16. Thus, the body 12 defines a cup portion, generally indicated at 19, with a closed bottom and an open top portion to permit liquid to be poured into and removed from the body 12. In the illustrated embodiment, the cup portion 19 has a volume of approximately ten ounces with an indicator line 21 disposed at an eight ounce level. The top portion 18 may be covered with a lid (not shown). It can be appreciated that the cup portion 19 may be of configurations other than a cylindrical volume, such as, for example, an octagonal or a square volume.

Figure 4:
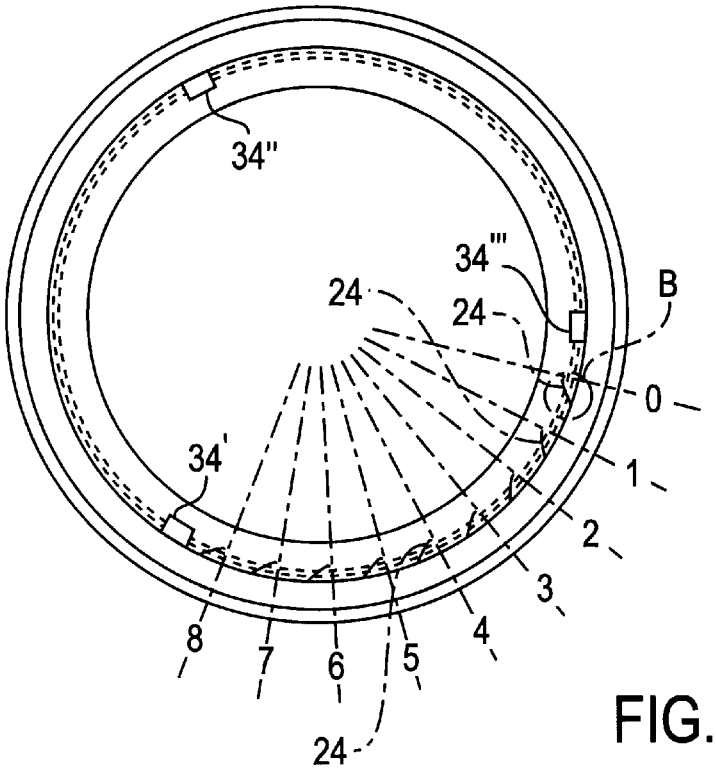
FIG. 4 is a bottom view of the body of the container assembly of the invention showing the location of the recesses and indicator.
Figure 5:
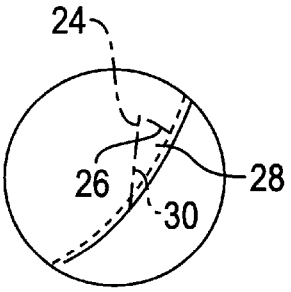
FIG. 5 is an enlarged view of a recess of the skirt member encircled at B in FIG. 4.
Figure 9:
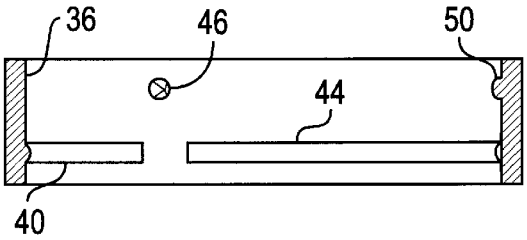
FIG. 9 is a sectional view taken along the line 9—9 in FIG. 6.
Figure 8:
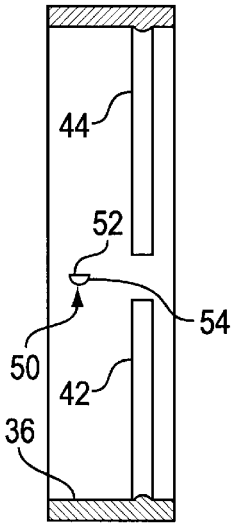
FIG. 8 is a sectional view taken along the line 8—8 in FIG. 6.
Figure 6:
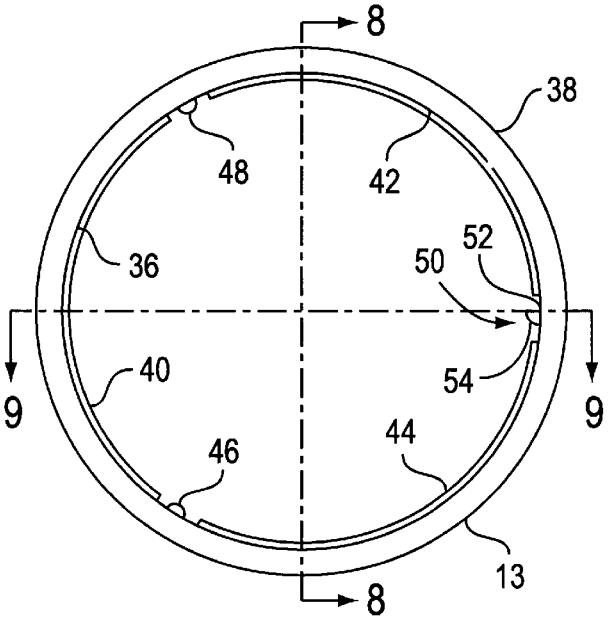
FIG. 6 is a plan view of the indicator ring structure of the container assembly of the invention.
Figure 7:
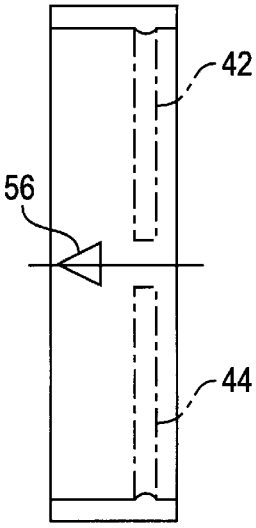
FIG. 7 is a front view of the indicator ring structure of the container assembly of FIG. 6.

The base portion 16 includes a generally cylindrical skirt member 20 extending from the body 12 generally adjacent to the bottom 17. As best shown in FIGS. 2 and 3, the skirt member 20 is a generally cylindrically-shaped member extending from the base portion 16. A pair of axially spaced grooves 22' and 22" are defined in the circumferential surface of the skirt member 20. A plurality of circumferentially spaced recesses 24, defining engaging structure, are provided within one of the grooves, in particular, groove 22". Each of the recesses 24 is generally of "D-shape" configuration defining a stopping surface 26, a receiving portion 28, and a camming surface 30 (FIGS. 3–5). The camming surface 30 is a tapered surface tapering from the receiving portion 28 to the juncture with the surface defining groove 22", as best shown in FIG. 5. The function of the camming surface 30 will become apparent below.

Indicia, generally indicated at 32, in the form of consecutive numbers are provided on the body 12 such that one number is associated with one recess 24 to indicate a number of consumptive uses of the container assembly 10. In the illustrative embodiment, there are nine recesses 24 corresponding to consecutive numbers "0" to "8" so that a user may be able to monitor the consumption of eight glasses of water per day, as will be explained more fully below. Of course, more or less consecutive numbers indicating consumptive uses may be provided on the body 12, together with a corresponding number of recesses 24 in the skirt member 20. Further, instead of providing numbers "0" to "8" to indicate consumptive uses, the indicia may be the successive volume consumed, for example, "8 ounces", "16 ounces", etc. Thus, the term "consumptive uses" as used herein refers to numbers of uses of the container assembly 10 or to volumes of liquid consumed from the container assembly 10.

As best shown in FIGS. 3 and 4, the skirt member 20 includes a plurality of longitudinally disposed slots 34 therein. In the illustrated embodiment, there are three slots 34, evenly spaced about the skirt member 20 and extending the height of the skirt member 20. The purpose of the slots is to locate the indicator ring structure 13 of the container assembly 10 with respect to the skirt member 20 during assembly, as will become apparent below.

With reference to FIGS. 6–9, the indicator ring structure 13 is of ring shape having an inner circumferential surface 36 and an outer circumferential surface 38. The inner diameter of the indicator ring structure 13 is sized to be received on the skirt member 20 of the body 12. The outer diameter of the indicator ring structure 13 is generally equal in size to the outer diameter of the cup portion 19 so that when the indicator ring structure 13 is mounted on the skirt member 20, the cup portion 19 of the body 12 and the indicator ring structure 13 form a generally continuous cylindrical container assembly 10.

The indicator ring structure 13 has projections 40, 42 and 44 extending from the inner circumferential surface 36 thereof. These projections may be made in the form of one continuous annular projection, but, in the illustrated embodiment the projections 40, 42 and 44 are separated for ease of manufacture. The location of the projections 40, 42 and 44 on the indicator ring structure 13 is such that the projections may be received in the lower groove 22' in the skirt member 20 when assembled therewith.

Three protrusions 46, 48 and 50 are evenly spaced on the inner circumferential surface 36 of the indicator ring structure 13. Protrusions 46 and 48 are generally half-spheres and are sized to be received into slots 34' and 34", respectively, to locate the indicator ring structure 13 with respect to the skirt member 20 during assembly thereof. The protrusions 46 and 48 are also sized to be receive in the upper groove 22" in the skirt member and to slide in the groove 22" upon rotation of the indicator ring structure 13 relative to the body 12. A locking protrusion 50 (FIGS. 6 and 8) is of quarter-sphere or is "D-shaped" and thus has as stop surface 52 and a cam surface 54. The locking protrusion is also located to be received in slot 34'" upon assembly and then to be received in groove 22". It can be appreciated that the indicator ring structure 13 may be removed from the skirt member when each protrusion 46, 48 and 50 is aligned with an associated slot 34 and the indicator ring structure 13 is moved axially away from the skirt member 20.

The indicator ring structure 13 is assembled fully with the skirt member 20 of the body 12 when the protrusions 46, 48 and 50 are disposed in the upper groove 22" for sliding movement therein and the projections 40, 42 and 44 are disposed in the lower groove 22' for sliding movement therein. Thus, when assembled, the indicator ring structure 13 may be rotated manually with respect to the body 12.

With reference to FIGS. 1, 2, 4 and 6 the operation of the container assembly 10 will be appreciated. First, the user rotates the indicator ring structure 13 clockwise with respect to the body 12 such that an arrow or marker 56, disposed on the outer circumferential surface of the indicator ring structure 13, is aligned with the number "0" on the body 12. The location of arrow 56 corresponds to the location of the locking protrusion 50. Thus, in this position, the locking protrusion is disposed in the receiving portion 28 of the recess 24 corresponding to the "0" consumption number. The user then fills the cup portion 19 up to at least the 8-ounce level with water and consumes the water. Thereafter, the user rotates the indicator ring structure 13 clockwise until the arrow 56 aligns with the number "1" on the body 12 to indicate that the user had consumed at least one 8-ounce cup of water. This process is repeated until eight, eight or more ounce cups of water have been consumed.

It can be appreciated that when the indicator ring structure 13 is rotated counter-clockwise and the locking protrusion 50 enters a recess 24, rotation of the indicator ring structure 13 in the counter-clockwise direction is prevented since stop surface 52 of the locking protrusion 50 engages stopping surface 26 of the associated recess 24. Thus, inadvertent movement of the indicator ring structure 13 in the counter-clockwise direction is prevented.

When the locking protrusion 50 is disposed in a recess 24 and the indicator ring structure 13 is rotated further clockwise to the next consumption indication number, the cam surface 54 of the locking protrusion 50 engages or rides on camming surface 30 of the recess 24 permitting the locking protrusion 50 to exit the recess and to move to the next, adjacent recess 24.

When the indicator ring structure 13 is rotated to the number "8" indicating that all eight cups of water had been consumed, the user knows the proper amount of water had been consumed that day. The user may then rotate the indicator ring structure 13 in the clockwise direction until the arrow 56 aligns with "0" once again to reset the indicator ring structure 13 for monitoring water consumption for the next day.

Although, in the illustrative embodiment, the recesses are provided in the skirt member of the body and the protrusion is provided in the indicator ring structure, it can be appreciated that the indicator ring structure may include the recesses while the skirt member includes the protrusion, with the indicia being disposed on the indicator ring structure.

It has thus been seen that the object of this invention have been fully and effectively accomplished. It will be realized, however, that the foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A container assembly for use in monitoring consumption of a liquid from the container assembly, the assembly comprising:

a body constructed and arranged to hold a liquid, said body having a base portion and an opposing, open top portion, said base portion having a skirt member, indicator structure operatively associated with said skirt member for rotational motion relative to said body into a plurality of different positions, a plurality of indicia on one of said body and said indicator structure to indicate consumptive uses of said container assembly, complementary engaging structure on said skirt member and on said indicator structure for mounting said indicator structure with respect to said skirt member in such a manner that rotation of said indicator structure is possible in one direction and rotation of said indicator structure is prevented in the opposite direction, said engaging structure including at least one protrusion on one of said indicator structure and said skirt member and a series of spaced recesses in the other of said indicator structure and said skirt member, each of said recesses corresponding to a particular indicia of said plurality of indicia, allowing the user, with each consumptive use, to rotate said indicator structure with respect to said body in said one direction to engage said at least one protrusion with a said recess, thereby monitoring consumptive uses of the container assembly, said skirt member being a generally cylindrical member, said indicator structure being in the form of a ring and having an inside diameter greater than an outer diameter of said skirt member so as to be received by said skirt member, said engaging structure comprising said at least one protrusion extending from an inner surface of said indicator structure and said plurality of circumferentially spaced recesses in the generally cylindrical skirt member, wherein said skirt member has a first groove and a second groove disposed in axially spaced relation in a peripheral surface thereof, each of said recesses being disposed in said first groove, and said indicator structure has at least one projection extending from said inner surface thereof, said projection being received in said second groove.

2. The assembly according to claim 1, wherein said at least one protrusion has a cam surface and each of said recesses has a camming surface such that upon rotation of said indicator structure in said one direction, said protrusion may engage a recess, further movement of said indicator structure causing said cam surface to engage said camming surface permitting said at least one protrusion to move from said recess to an adjacent recess.

3. The assembly according to claim 2, wherein said at least one protrusion has a stop surface and each of said recesses has a stopping surface such that when said at least one protrusion is within a recess, movement of said indicator structure in said opposite direction causes said stop surface to engage said stopping surface thereby preventing movement of said indicator structure in said opposite direction.

4. The assembly according to claim 2, wherein said cam surface is a tapered surface so as to slide along said camming surface as said indicator structure is rotated in said one direction.

5. The assembly according to claim 1, wherein said plurality of indicia comprises a series of consecutive numbers disposed on said body, and a marker on an outer surface of said indicator structure corresponding to a location of said at least one protrusion, such that when said at least one protrusion is disposed within a recess, said marker aligns with one of said consecutive numbers.

6. The assembly according to claim 1, wherein said body is generally cylindrical and said skirt member has an outer diameter smaller than an outer diameter of said body, and wherein said indicator ring structure has an outer diameter generally equal to the outer diameter of said body.

7. The assembly according to claim 1, wherein said skirt member includes three slots therein, said slots being spaced evenly and extending axially an entire height of said skirt member, and wherein two extending members are provided on said inner surface of said indicator structure, said extending members and said at least one protrusion being spaced equally on said inner surface so as to be received in said first groove, whereby when each of said extending members and said at least one protrusion is disposed in an associated slot, said indicator structure may be removed from said skirt member.

8. A container assembly for use in monitoring consumption of a liquid from the container assembly, the assembly comprising:

a body constructed and arranged to hold a liquid, said body having a base portion and an opposing, open top portion, said base portion having a generally cylindrical skirt member, said skirt member having a plurality of recesses therein, said recesses being disposed in spaced relation and each of said recesses having a camming surface and a stopping surface, ring-shaped indicator structure mounted on said skirt member for rotational motion relative to said body into a plurality of different positions, said indicator structure having a protrusion extending from an inner peripheral surface thereof, said protrusion being sized to be received in a said recess and having a cam surface and a stop surface, a plurality of indicia on said body, each indicia being disposed generally adjacent to one of said recesses, said indicia indicating consumptive uses of the container assembly, said indicator structure having a marker indicating a location of said protrusion and being mounted with respect to said skirt member such that as said indicator structure is rotated, (1) in one direction upon a consumptive use of said container assembly, said protrusion may enter a recess with said marker aligning with one of said indicia to indicate a consumptive use of said container assembly, and further movement of said indicator structure causes said cam surface of said protrusion to engage a camming surface of said recess permitting said protrusion to move to an adjacent recess to indicate another consumptive use of said container assembly, and (2) in a direction opposite said one direction, said stop surface of said protrusion may engage a stopping surface of a recess preventing further movement of said indicator structure in said opposite direction, wherein said skirt member has a first groove and a second groove disposed in axially spaced relation in a peripheral surface thereof, each of said recesses being disposed in said first groove, and said indicator structure has at least one projection extending from said inner surface thereof, said at least one projection being received in said second groove.

9. The assembly according to claim 8, wherein said indicia comprises a series of consecutive numbers disposed on said body, such that when said protrusion is disposed within a recess, said marker aligns with one of said consecutive numbers.

10. The assembly according to claim 8, wherein said skirt member has an outer diameter smaller than an outer diameter of said body, and wherein said indicator ring structure has an outer diameter generally equal to the outer diameter of said body.

11. The assembly according to claim 8, wherein said skirt member includes three slots therein, said slots being spaced evenly and extending axially an entire height of said skirt member, and wherein two extending members are provided on said inner surface of said indicator structure, said extending members and said protrusion being spaced equally on said inner surface so as to be received in said first groove, whereby when each of said extending members and said protrusion is disposed in an associated slot, said indicator structure may be removed from said skirt member.

12. A container assembly for use in monitoring consumption of a liquid from the container assembly, the assembly comprising:

a body constructed and arranged to hold a liquid, said body having a base portion and an opposing, open top portion, said base portion having a generally cylindrical skirt member, said skirt member having at least nine recesses disposed in circumferentially spaced relation therein, each of said recesses having a camming surface and a stopping surface, ring-shaped indicator structure mounted on said skirt member for rotational motion relative to said body into a plurality of different positions, said indicator structure having a protrusion extending from an inner peripheral surface thereof, said protrusion being sized to be received in a said recess and having a cam surface and a stop surface, a series of consecutive numbers on said body generally adjacent an associated recess, said indicator structure having a marker indicating a location of said protrusion and being mounted with respect to said skirt member such that as said indicator structure is rotated, (1) in one direction upon a consumptive use of said container assembly, said protrusion may enter a recess with said marker aligning with one of said consecutive numbers to indicate a consumptive use of said container assembly, and further movement of said indicator structure causes said cam surface of said protrusion to engage a camming surface of said recess permitting said protrusion to move to an adjacent recess to indicate another consumptive use of said container assembly, and (2) in a direction opposite said one direction, said stop surface of said protrusion may engage a stopping surface of a recess preventing further movement of said indicator structure in said opposite direction, wherein said skirt member includes three slots therein, said slots being spaced evenly and extending axially an entire height of said skirt member, and wherein two addition protrusions on said inner surface of said indicator structure, said protrusions being spaced equally, whereby when each said protrusion is disposed in an associated slot, said indicator structure may be removed from said skirt member.

* * * * *